US008640980B2

(12) United States Patent
Nordstrom

(10) Patent No.: US 8,640,980 B2
(45) Date of Patent: Feb. 4, 2014

(54) SHOWERHEAD

(75) Inventor: Lindsay Nordstrom, Glenorie (AU)

(73) Assignee: Exell Technology Pty Limited, New South Wales (AU)

( * ) Notice: Subject to any disclaimer, the term of this patent is extended or adjusted under 35 U.S.C. 154(b) by 0 days.

(21) Appl. No.: 12/937,835

(22) PCT Filed: Apr. 9, 2009

(86) PCT No.: PCT/AU2009/000426

§ 371 (c)(1),
(2), (4) Date: Nov. 16, 2010

(87) PCT Pub. No.: WO2009/126987

PCT Pub. Date: Oct. 22, 2009

(65) Prior Publication Data

US 2011/0101132 A1 May 5, 2011

(30) Foreign Application Priority Data

Apr. 17, 2008 (AU) ..... 2008901882

(51) Int. Cl.

| | |
|---|---|
| ***B05B 1/18*** | (2006.01) |
| ***B05B 1/14*** | (2006.01) |
| ***B05B 1/34*** | (2006.01) |
| ***B05B 15/08*** | (2006.01) |

(52) U.S. Cl.
USPC ..... 239/555; 239/463; 239/490; 239/553; 239/556; 239/587.4

(58) Field of Classification Search
USPC ..... 239/548, 553, 554, 556–559, 562, 567, 239/587.1, 587.4, 462, 463, 472, 490
See application file for complete search history.

(56) References Cited

U.S. PATENT DOCUMENTS

| | | | | |
|---|---|---|---|---|
| 2,878,066 | A | 3/1959 | Erwin | |
| 4,244,526 | A | 1/1981 | Arth | |
| 4,561,593 | A | 12/1985 | Cammack et al. | |
| 6,076,747 | A | 6/2000 | Ming-Yuan | |
| 6,142,390 | A | 11/2000 | Nordstrom et al. | |
| 6,497,374 | B1 | 12/2002 | Wu et al. | |
| 7,004,410 | B2 | 2/2006 | Li | |
| 2001/0008256 | A1 * | 7/2001 | Marsh et al. | 239/381 |
| 2004/0056123 | A1 * | 3/2004 | Douglas et al. | 239/587.4 |

* cited by examiner

*Primary Examiner* — Darren W Gorman
(74) *Attorney, Agent, or Firm* — Abelman, Frayne & Schwab

(57) ABSTRACT

A showerhead is disclosed that has a housing with an inlet and an outlet. There is a ball joint at the inlet of the housing adapted to be connected to a source of water and a spacer within the housing channels water from the inlet towards the outlet. Within the spacer is a flow control disc having one or more apertures. Each aperture is surrounded by a chamber within the disc, and the depth of each chamber partially controls the spray dispersion of the water flowing through the spacer. There is also an outlet cap removeably retained in the outlet of the housing. The outlet cap has a plurality of nozzle chambers each being fed by an aperture of the disc. The depth of each nozzle chamber is such as to also partially control the spray dispersion of the water discharged from the showerhead.

11 Claims, 8 Drawing Sheets

SHOWERHEAD

TECHNICAL FIELD

The present invention relates to showerheads, and more particularly to water saving showerheads.

BACKGROUND ART

Many locations around the world are currently experiencing a major water deficit. In Australia for instance, research conducted by the Australian Water Services Association in 2005 showed there will be a national shortfall of 275 giga-liters—about one half of Sydney Harbour—by 2015, and 818 giga-liters by 2030.

In Australia, Sydney and Brisbane will be the worst-affected, needing to cut consumption by 54 percent and 51 percent respectively, to prevent a dire water shortage by 2030. Melbourne and Perth need reductions of 41 percent.

The research shows that 27 giga-liters of water more than the sustainable yield of the Australia's storage system is being used each year, despite water restrictions and increasing government attempts to promote water conservation.

The shortfall is caused by climate change, declining rainfall, population growth, more water being used for environmental flows, and insufficient measures to curb water use.

The looming deficit in Australia is particularly alarming because it assumes Australians would have conserved about 7 percent more water than they were presently using, that 25 percent of all new developments would have recycled water, and that water-efficient washing machines and appliances would be standard.

Large-scale engineering solutions, such as desalination plants and the reuse of stormwater and waste water, need to be balanced against the energy requirements and increased greenhouse gas emissions of such projects.

The bathroom is responsible for a high percentage of household water consumption and the shower plays a leading role. It is estimated that the average shower experience is around 8 minutes, and recent Government initiatives in Australia are encouraging a reduction of this time to 4 minutes.

A majority of homes in Australia (estimated to be in excess of 70%), have showerheads that are capable of flowing at 20 liters per minute. Therefore, an 8 minute shower could consume as much as 160 liters of water.

If four people in the same home were to take an 8 minute shower, then around 640 liters of water could be consumed each day or 4,480 liters per week or 232,960 liters per year.

The use of a 'water saving' showerhead that consumes around 5 liters per minute, would provide water savings of around 75%.

However, many water saving showerheads currently available have either a spray angle which is too wide or too narrow for adequate user comfort. Some other water saving showerheads emit 'bullet-like' fingers of water, which not only reduces user comfort, but also allows more of the water to come into contact with air from the time the water is emitted from the showerhead to the time it makes contact with the user of the shower, significantly reducing the temperature of the water. Other water saving showerheads have a weak water spray. These problems result in substantially reduced comfort for the user, and a decreased overall adoption of water saving showerheads.

Moreover, some water saving shower systems involve recycling water used within the shower, a prospect which many users would not find appealing.

Therefore, it is an object of the present invention to provide a showerhead which has a flow rate of around 5 liters of water per minute, yet provides a solid spray cone, wherein all of the volume of the spray cone is utilised and where the spray cone is of sufficient intensity to optimise user comfort and enjoyment.

SUMMARY OF THE INVENTION

According to the present invention there is provided a showerhead comprising a:

(i) housing having an inlet and an outlet, (ii) a ball joint at the inlet of the housing adapted to be connected to a source of water, (iii) a flow control disc within the housing, the disc having one or more apertures, the or each aperture being surrounded by a chamber within the disc, the depth of each chamber partially controlling the spray dispersion of the water flowing through the spacer, (iv) an outlet cap removeably retained in the outlet of the housing and a plurality of outlet nozzle chambers in the outlet cap, each nozzle chamber being fed by an aperture of the disc, the depth of each nozzle chamber also partially controlling the spray dispersion of the water discharged from the showerhead.

Preferably, the showerhead further comprises a spacer located within the housing between the ball joint and the flow control disc, for channelling water.

In one embodiment of the present invention, the showerhead is adapted to channel water at the rate of around 3 to 6 liters per minute; however, the showerhead may be adapted to flow at any rate.

For flow rates above 6 liters per minute, it is preferred that the showerhead also include a flow rate restrictor, which may be positioned in the ball joint, to ensure that the flow rate of the showerhead does not vary by more than 2 liters per minute between 150 kPa and 350 kPa pressure.

Preferably, the ball joint is made of metal (such as brass with either chrome plating or powder coating), but may also be made of plastic (with or without chrome plating).

It is preferred that the housing is made of plastic (with or without chrome plating), but may alternatively or also be made of metal.

In a preferred embodiment, one or more filters are placed between the water source and the ball joint for trapping extraneous particles present in the water source. Preferably, the or each filter is a mesh of stainless steel. The or each filter may be retained in position by means a washer which may be made of rubber or a plastic polymer. In another embodiment, one or more filters may be built into a washer.

It is preferred that a grommet is placed between the ball joint and the spacer for preventing water from leaking into the housing. More preferably, the grommet is made of rubber.

Preferably, an o-ring is placed as a water seal between the outlet cap and the housing. More preferably, the o-ring is made of rubber.

BRIEF DESCRIPTION OF THE DRAWINGS

In order that the invention may be more readily understood and put into practical effect, reference will now be made to the accompanying drawings in which:—

DETAILED DESCRIPTION OF THE PREFERRED EMBODIMENT

Figures 1, 2:
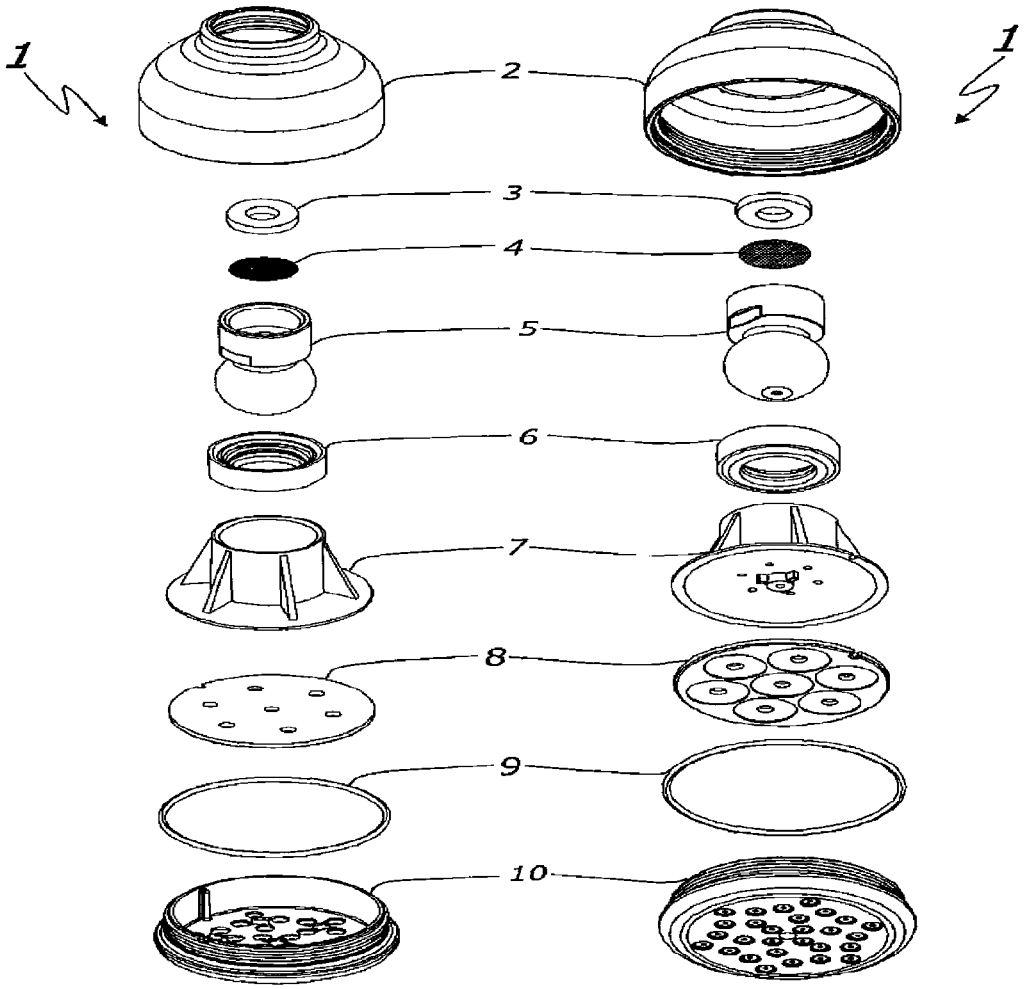
FIG. 1 is a top exploded view of the components of a preferred showerhead of the present invention.
FIG. 2 is a bottom exploded view of the components of the showerhead of FIG. 1.
Figure 3:
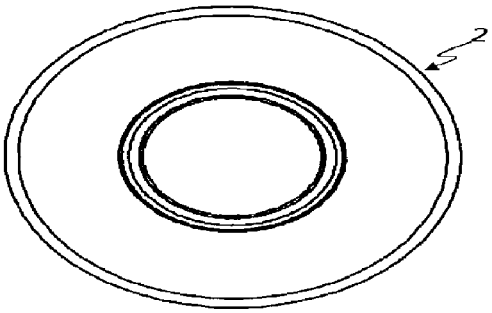
FIG. 3 is a top view of the housing of the showerhead of FIG. 1.

The showerhead 1 shown in the exploded view of FIG. 1 is preferably adapted to flow at the rate of around 3 to 9 liters per minute as a water saving showerhead, but may be adapted to flow at any rate for any purpose.

The housing 2 of the showerhead 1 may be of made of metal, but it is preferred that the housing 2 is made of plastic because of its light weight, rust resistance, durability, cheap cost, and ease of manufacture.

In this instance, the housing 2 is 35.2 mm high and 64.9 mm wide. However, the housing 2 may have any convenient shape, design or dimensions, as it is not essential to the operation of the invention. In use, water does not travel throughout the housing 2 in its entirety, but rather through a spacer 7 (refer to FIGS. 9, 10 and 11) within the housing 2 (as will be described in greater detail below).

The rim 12 of the housing 2 is threaded so as to interface with a thread 12 on an outlet cap 10 and thereby encapsulate the components of the showerhead 1 shown in FIGS. 1 and 2 which include the rubber retaining washer 3, mesh filter 4, ball joint 5, ball joint grommet 6, spacer 7, flow control disc 8, and o-ring 9.

Figure 4:
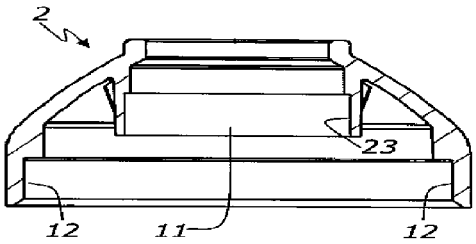
FIG. 4 is a side sectional view of the housing of the showerhead of FIG. 1.
Figure 5:
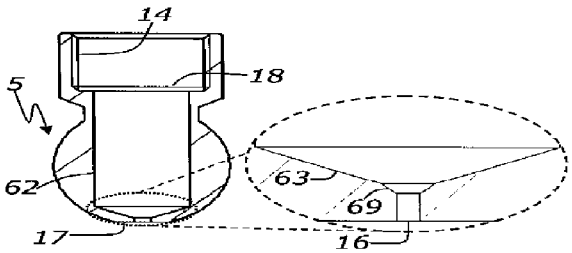
FIG. 5 is a cross sectional view of the ball joint of the showerhead of FIG. 1 with an enlarged view of a circled region of the ball joint.

During assembly of the showerhead 1, the housing 2 receives the ball joint 5, through aperture 11 at the bottom of the housing 2 (see FIGS. 4 and 5). The ball joint 5 is preferably, in this instance, made of metal, such as brass with either chrome plating or powder coating, but may also be made of plastic (with or without chrome plating).

The ball joint 5 has, in this instance, a ball diameter of 26.7 mm and a body length of 43.0 mm. The rim 14 of the ball joint 5 is threaded (see FIG. 19) by either National Pipe Straight (NPS) thread, British Standard Pipe (BSP) thread, or any other thread type, so as to interface with a thread on the shower recess (which is not shown).

The outlet 16 out of the ball joint 5 is preferably 2.5 mm in diameter in order to create sufficient pressure out of the showerhead 1 to optimise user comfort during the shower (see FIG. 5). However, the outlet 16 may range in diameter from 1.5 mm up to 10 mm in diameter The edge 69 of the ball joint 5 is chamfered, as shown in the enlarged portion of FIG. 5. Likewise the bottom 17 of the ball joint 5 is chamfered, and the bottom of the exit channel 62 (within the ball joint 5) has a bevelled edge 63 to facilitate the exit of the water out of the ball joint 5. The angle of the bevelled edge 63 can vary within the range of 10° to 30°, and is preferably 20°.

Showerheads in Australia are evaluated according to the Australian and New Zealand Standard No. AS/NZS 3662: 2005 entitled 'Evaluated to Performance of Showers for Bathing'. Showerheads which conform with this standard are granted a rating by Water Efficiency Labelling Scheme (WELS). The showerheads are tested by a laboratory authorised by Standards Assurance Innovation (SAI) Global. According to this standard, there are currently four categories of water saving showerhead.

A zero star showerhead flows at a rate of more than 16 liters per minute, a one star showerhead flows at a rate of more than 12 but not more than 16 liters per minute, a two star showerhead flows at a rate of more than 9 but not more than 12 liters per minute, a three star showerhead flows at a rate more than 4.5 but not more than 9 liters per minute.

The present invention achieves a three star showerhead rating with a flow rate in the range of 4.5 to 6 liters per minute. However, if a showerhead with a flow rate of above 6 liters per minute is required, then a flow rate restrictor 65 (see FIG. 19) may be necessary. This is to ensure that the flow rate between 150 kPa and 350 kPa pressure does not vary by more than 2 liters per minute, as required by standard AS/NZS 3662:2005.

Figure 19:
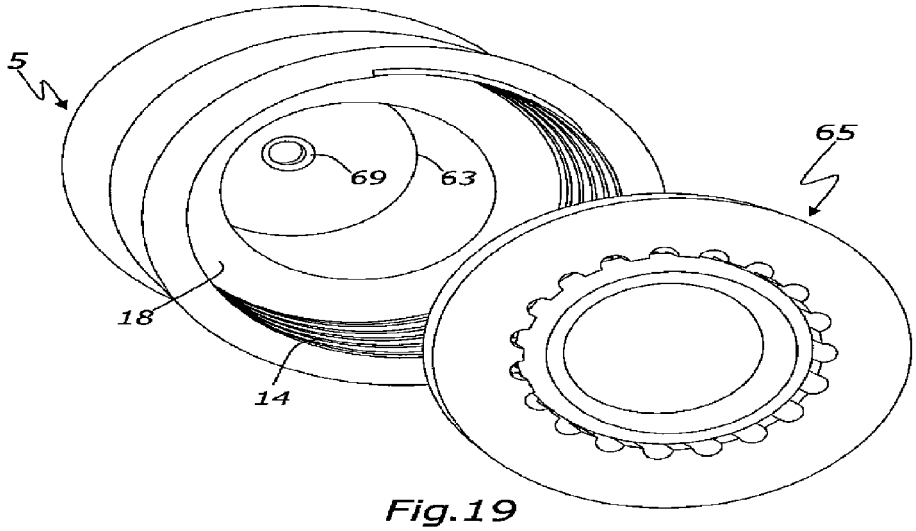
FIG. 19 is an exploded view of a flow restrictor for use with the ball joint of FIG. 5.

The flow rate restrictor 65 would be locked (or pressed) into the ball joint 5, over the aperture 18, before the mesh filter 4 which would hold it into position within the neck of the ball joint 5 (see FIG. 19).

Figure 6:
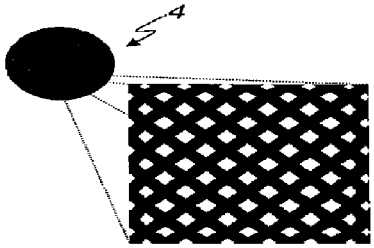
FIG. 6 is a front view of the mesh filter of the showerhead of FIG. 1, showing an enlarged view of a square region of the mesh filter.

The mesh filter 4, within the ball joint 5, is a stainless steel wire mesh of approximately 0.4 mm by 0.4 mm mesh size. An enlarged view of a square region of the mesh filter 4 is shown in FIG. 6. The mesh filter 4 has an overall diameter of 18.0 mm, equal in diameter to aperture 18 in the ball joint 5 (shown in FIG. 5). The mesh filter 4 is positioned in the sequence of components as shown in FIGS. 1 and 2.

Figure 14:
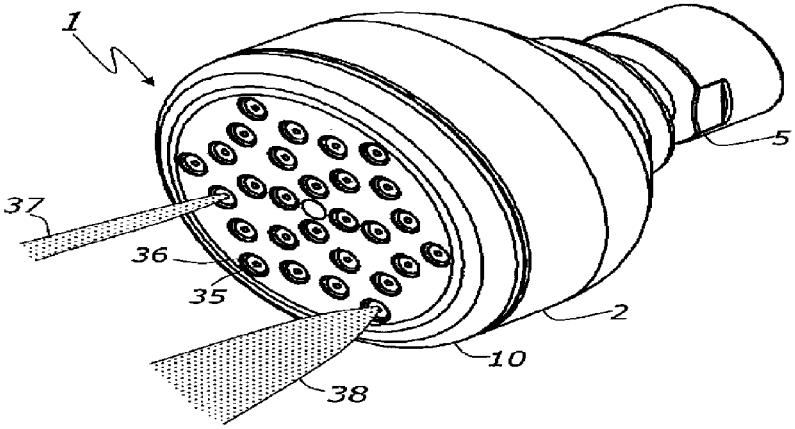
FIG. 14 is a perspective view of the showerhead of FIG. 1 in use.

The mesh filter 4 is intended to prevent extraneous particles from the water supply entering the housing 2 of the showerhead 1, and thereby causing blockages in the small holes 28 in the spacer 7 (refer to FIG. 10), the holes 33 in the flow control disc 8 (refer to FIG. 12), and the exit holes 35 in the outlet cap 10 (refer to FIG. 14). Preferably two mesh filters 4 are placed over aperture 18 to increase the chance that an extraneous particle will be trapped.

Figure 7:
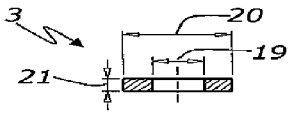
FIG. 7 is a side sectional view of the mesh retaining washer of the showerhead of FIG. 1.

The mesh filter 4 is held in position by rubber retaining washer 3, which is shown in the sequence of components in FIGS. 4 and 5. The rubber retaining washer 3 is shown in a side section view in FIG. 7.

Preferably, the rubber retaining washer 3 has an inner diameter 19 of 9 mm, and an outer diameter 20 of 19 mm, and a height 21 of 3 mm.

Figure 20:
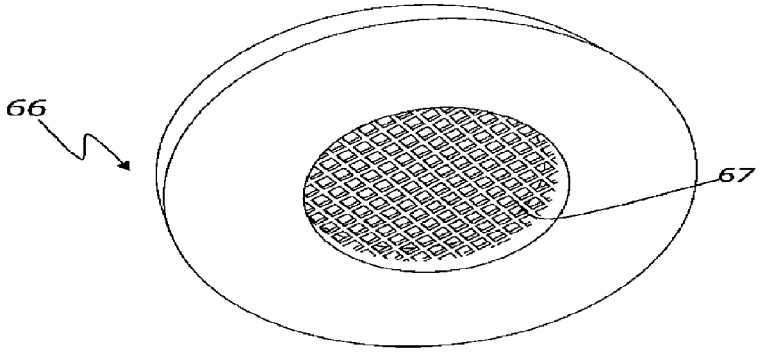
FIG. 20 is a perspective view of a mesh retaining washer with in-built filter for use with the showerhead of FIG. 1.

Alternatively, it is possible to use a washer which has one or more mesh filters 67 internally built into it, such as washer 66 in FIG. 20. In this instance the external diameter of the washer is 18 mm, and the internal diameter is 9 mm (that is, the washer 66 presents a 9 mm diameter of the mesh filter 67).

The ball joint 5 is held in position by ball joint grommet 6, shown in the sequence of components in FIGS. 1 and 2. The ball joint grommet 6 is also shown in the close up side sectional view of FIG. 8.

The ball joint grommet 6 is positioned within rim 23 on housing 2 (see FIG. 4). The ball joint grommet 6 has a plurality of ridges 22 on its inner surface which are designed to frictionally engage a portion of the surface of the ball joint 5. The ball joint grommet 6 is coated in a lubricant such as Vaseline, before placement, in order to enhance the water tight seal, and to facilitate the insertion of the grommet 6 in position.

Figure 8:
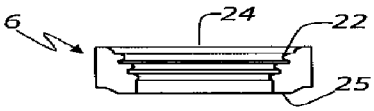
FIG. 8 is a side sectional view of the ball joint grommet of the showerhead of FIG. 1.

The top side 24 of the ball joint grommet 6 is 32 mm in diameter in the embodiment of the present invention depicted in FIG. 8. The bottom side 25 of the ball joint grommet 6 is 32 mm in outer diameter, and slopes down to an exit hole of 20 mm.

The bottom side 25 of the ball joint grommet 6 interfaces with the slanted ledge 26 of the spacer 7. The spacer 7 is 32 mm in outer diameter. The spacer 7 is preferably made of plastic, but may also be made of metal, or any other suitable material.

Figure 9:
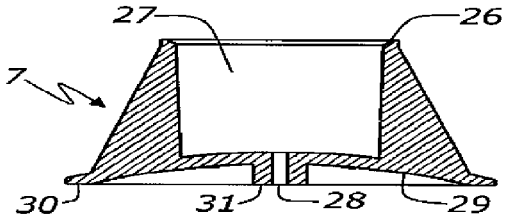
FIG. 9 is a cross sectional view of the spacer of the showerhead of FIG. 1.
Figure 10:
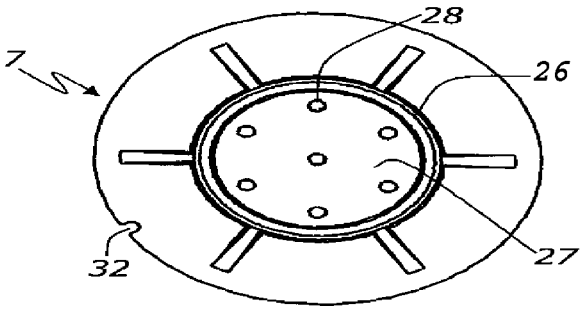
FIG. 10 is a top view of the spacer of the showerhead of FIG. 1.

In use, water emerges from the outlet 16 of the ball joint 5 and passes into the chamber 27 of the spacer 7 (see FIGS. 9 and 10).

The water then passes through holes 28. Although 7 holes 28 are shown, there may be any number of holes 28, which are preferably about 2 mm in diameter, but may be any convenient size depending on the desired flow rate.

Figure 11:
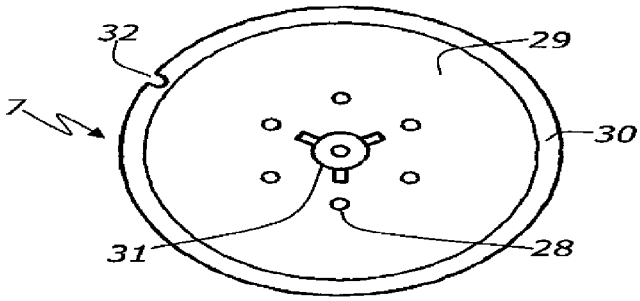
FIG. 11 is a bottom view of the spacer of the showerhead of FIG. 1.

The entrance side of the holes 28 on the spacer 7 (see FIG. 10), is slightly larger, on order of 0.1 mm, than the exit side of the holes 28 on the spacer 7 (see FIG. 11). In addition, the entrance side of the holes 28 on the spacer 7 shown in FIG. 10 is filleted. This is to prevent the pins (which are not shown in the Figures), which are used to make the holes 28 during manufacture of the spacer 7, from sticking within the injection mould, and thereby enabling the pins to be effectively withdrawn without damaging the pins and the spacer 7.

The base 29 of the spacer 7 is concave in shape and supported by rim 30 and strut 31.

Figure 12:
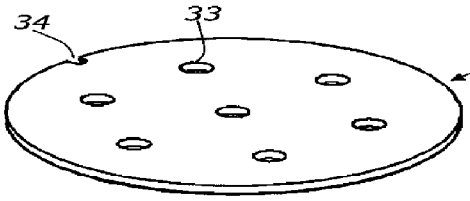
FIG. 12 is a top perspective view of the flow control disc of the spacer of the showerhead of FIG. 1.

The water travels through the recess created by the concave shape of the spacer 7, and then through the holes, such as hole 33, in the top of the flow control disc 8 (see FIG. 12). The holes 33 are 4 mm in diameter, but can vary according to the desired flow rate or spray dispersion. There may be any number of holes 33 or configuration of holes 33 in the flow control disc 8 according to the present invention.

Figure 13:
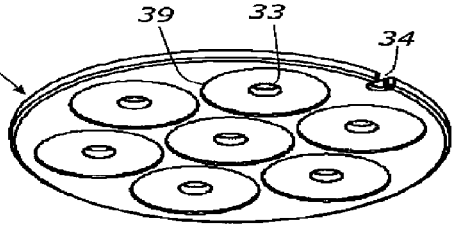
FIG. 13 is a bottom perspective view of the flow control disc of the spacer of the showerhead of FIG. 1.

The flow control disc 8 shown in FIGS. 12 and 13, in this instance, is 55 mm in diameter, and 2 mm in height. The bottom of the flow control disc 8 has chambers 39, which in this instance are 16 mm in diameter.

The provision of chambers 39 allows the manufacturer to control the spray dispersion (spray angle) of water from an exit hole 35 on an exit outlet 36 toward the outlet cap 10 of the showerhead 1.

In this instance, the exit hole 35 is about 1 mm in diameter, which can vary from 0.05 mm to 2 mm. The exit outlet 36 is bevelled for aesthetic and ease of cleaning purposes to a diameter of about 5 mm.

increasing the depth of the disc chambers 39 produces a spray 37 with a narrow spray angle and conversely, decreasing the depth of the disc chambers 39 produces a spray 38 with a wide spray angle (see FIG. 14).

The disc chambers 39, can range in depth from flat (which increases the dispersion of the spray) to almost the full width of the flow control disc 8 (which produces a narrower spray), but are preferably 0.5 mm in depth, so as to optimise the showerhead 1 for user comfort during a shower.

Figure 15:
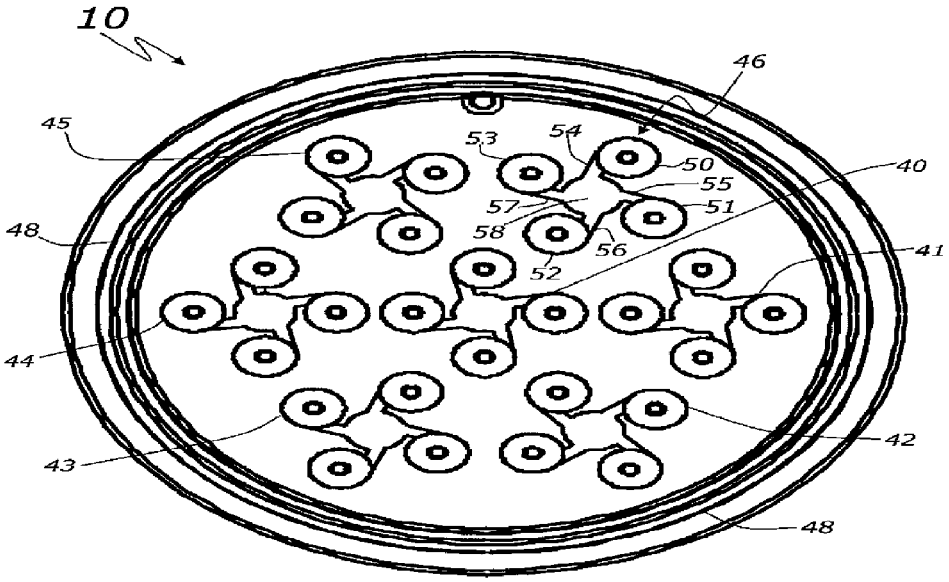
FIG. 15 is a top view of the outlet cap of the showerhead of FIG. 1.

The embodiment of the outlet cap 10 shown in FIG. 15 includes an array of swirl chambers 41 to 46, around the central swirl chamber 40. The swirl chambers 40 to 46 can vary in their overall width, the number of exit holes, the size of those exit holes, and the configuration of the exit holes, according to the size of the outlet cap 10.

The swirl chambers 40 to 46 are marginally smaller (on the order of about 0.1 mm) in diameter than the diameter of the disc chambers 39 on the flow control disc 8 (refer to FIG. 13). That is, the swirl chambers 40 to 46 are marginally less than 16 mm in width, respectively.

Each swirl chamber 40 to 46 is comprised of 4 nozzle chambers 50 to 53 (see FIG. 15), wherein the central nozzle chamber 58 has no exit nozzle. There may be any number of nozzle chambers according to the present invention.

In use, water passes through an aperture 33 in the flow control disc 8, and then into the disc chamber 39. The water then passes onto the swirl chamber 46 and is first directed at the central nozzle chamber 58, and then exits the showerhead 1 via the nozzle chambers 50 to 53, for example, depicted as water stream 37 in FIG. 14.

If there is no disc chamber 39, that is, the flow control disc 8 is flat, then the water passes into the centre chamber 58, and then along the channels 54 to 57. The channels 52 can vary in length and width. Preferably, the channels 52 are about 1 mm wide in this instance, but can be widened, lengthened or shortened according to the requirements of the present invention.

Figure 17:
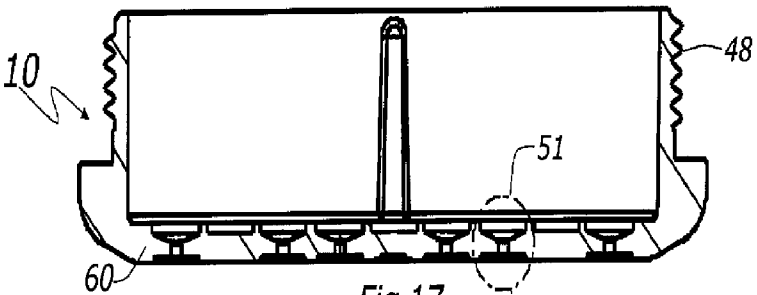
FIG. 17 is a cross sectional view of the outlet cap of the showerhead of FIG. 1.
Figure 18:
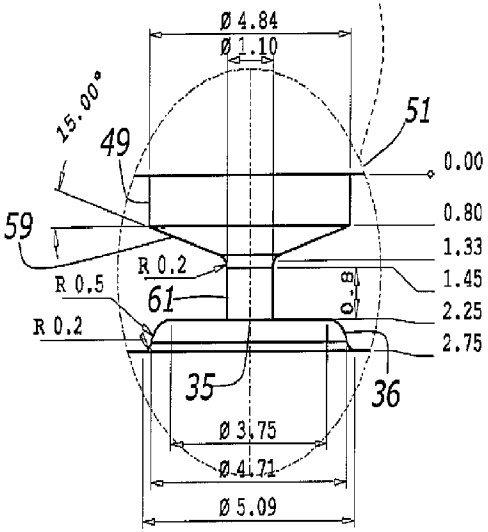
FIG. 18 is an enlarged view of a circled region of the outlet cap of the showerhead of FIG. 1.

The nozzle chamber 51 shown in FIGS. 17 and 18 is representative of all of the nozzle chambers 50 to 53 in all of the swirl chambers 40 to 46.

As shown in FIG. 18, the nozzle chamber 51 has a bevelled edge 59 at angle of 15° from the horizontal, so that the water travels in a swirling motion within the nozzle chamber 51 before leaving the showerhead 1 via the channel 61 (see for example, the water stream 38 in FIG. 14). The centre chamber 58 is not bevelled.

The depth 49 of the nozzle chambers 50 to 53 is 0.8 mm in this instance. However, the depth 49 may vary from 0 mm to 2 mm, measured from the top surface of the outlet cap 10 to the bevelled edge 59, depending upon the application and requirements of present invention.

In the instance that the swirl chambers 40 to 46 are flat, then the only chamber which the water may travel through is the chamber 39 in the flow control disc 8.

The channel 61 shown in FIG. 18 is tapered so that it is marginally larger at the top than at the bottom. This is to enable pins to more easily make the exit holes during manufacture of the outlet cap 10. In addition, the top of the channel 61 is filleted so that the pins can be more easily removed from the plastic injection mould, during manufacture of the outlet cap 10.

The channel 61 can vary in length according to thickness of the front wall 60 of the outlet cap 10.

The disc chambers 39 on the flow control disc 8 align with the swirl chambers 40 to 46 on the outlet cap 10 by means of female extrusion 34 (refer to FIGS. 12 and 13) and male protrusion 48. For example, disc chamber 39 in FIG. 13 would align with and encompass swirl chamber 46 shown in FIG. 15 and FIG. 16.

Similarly, the spacer 7 also has a female extrusion 32 which aligns with male protrusion 48, in order to prevent the spacer 7 from rotating within the housing 2, whilst in use, under the action of centrifugal forces created by the movement of water in a swirling motion.

Figure 16:
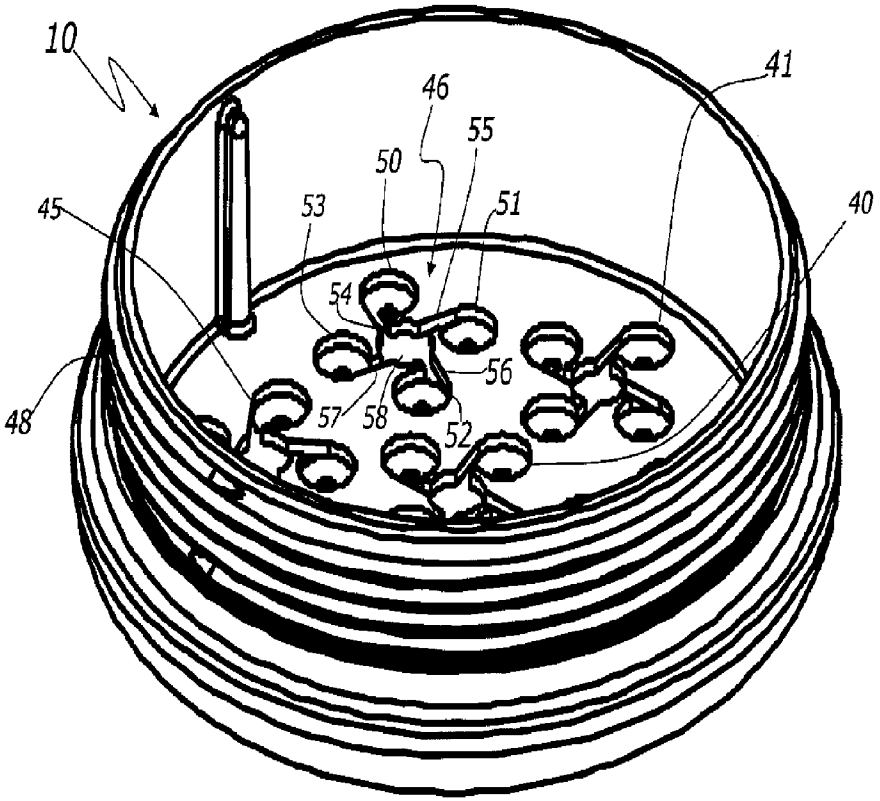
FIG. 16 is a perspective view of the outlet cap of the showerhead of FIG. 1.

As shown in FIGS. 16 and 17 there is a thread on the external edge of male protrusion 48 of the outlet cap 10, which interfaces with the internal threading on the rim 12 of the housing 2.

In an alternative embodiment of the present invention, the thread on the external edge of male protrusion 48 could have been made on the internal edge of the outlet cap 10, and the threading on the housing 2 could have been correspondingly adapted.

An o-ring 9 is generally placed as a water seal between outlet cap 10 and the housing 2, as shown in FIGS. 4 and 5. Preferably the o-ring is given a coating of a lubricant, such as Vaseline™, to enhance the water tight seal and facilitate assembly of the showerhead 1.

The showerhead 1 illustrated in the Figures can be adapted in size and shape, following the principles set out in this disclosure, for large scale purposes such as irrigation or garden hoses, which may require an economic use of water.

Although the invention has been herein shown and described in what is conceived to be the most practical and preferred embodiment as a water saving showerhead, it is recognised that departures can be made within the scope of the invention, which is not to be limited to the details described herein but is to be accorded the full scope and ambit of the invention so as to embrace any and all equivalent devices and apparatus.

Various modifications may be made in the details of design and construction without departing from the scope and ambit of the invention.

What is claimed is:

1. A showerhead comprising:

(i) a housing having an inlet and an outlet;

(ii) a ball joint at the inlet of the housing adapted to be connected to a source of water;

(iii) a spacer located in the housing for channeling the water from the ball joint towards the outlet;

(iv) a flow control disc within the housing between the spacer and the outlet, the flow control disc having a plurality of apertures and a corresponding plurality of disc chambers surrounding respective apertures; and (v) an outlet cap removably retained in the housing outlet and having a plurality of swirl nozzle chambers corresponding to the plurality of disc chambers of the flow control disc, with each swirl chamber being fed by an aperture of a respective flow control disc, and each swirl chamber comprising a plurality of nozzle chambers, including a central nozzle chamber having no exit nozzle and outer nozzle chambers having exit channels;

wherein the spray flowing from each aperture toward the outlet cap passes into a respective disc chamber and then passes into a corresponding swirl chamber from where it exits the showerhead via the exit channel in the outer nozzle chambers, and wherein the swirl chamber is configured such that the water travels in a swirling motion within each of the outer nozzle chambers before exiting the showerhead.

2. The showerhead of claim 1, wherein the showerhead is adapted to channel water at a rate of substantially 3 to 6 liters per minute.

3. The showerhead of claim 1, further comprising a flow rate restrictor positioned in the ball joint.

4. The showerhead of claim 1, wherein the ball joint is made of metal or plastic.

5. The showerhead of claim 1, wherein the housing is made of plastic, metal, or a combination of plastic and metal.

6. The showerhead of claim 1, wherein one or more filters are placed between the water source and the ball joint for trapping extraneous particles present in the water source.

7. The showerhead of claim 6, wherein the one or each filter is a mesh of stainless steel.

8. The showerhead of claim 1, further comprising a grommet which is placed between the ball joint and the spacer for preventing water from leaking into the housing.

9. The showerhead of claim 8, wherein the grommet is made of rubber.

10. The showerhead of claim 1, wherein an o-ring is placed as a water seal between the outlet cap and the housing.

11. The showerhead of claim 10, wherein the o-ring is made of rubber.

* * * * *